US010126007B2

(12) United States Patent
DeBusk

(10) Patent No.: US 10,126,007 B2
(45) Date of Patent: Nov. 13, 2018

(54) HUMIDITY DELIVERY METHOD AND APPARATUS

(71) Applicant: Damon Keith DeBusk, Blandon, PA (US)

(72) Inventor: Damon Keith DeBusk, Blandon, PA (US)

( * ) Notice: Subject to any disclaimer, the term of this patent is extended or adjusted under 35 U.S.C. 154(b) by 112 days.

(21) Appl. No.: 15/267,071

(22) Filed: Sep. 15, 2016

(65) Prior Publication Data

US 2017/0074531 A1 Mar. 16, 2017

Related U.S. Application Data

(60) Provisional application No. 62/219,348, filed on Sep. 16, 2015.

(51) Int. Cl.

| | |
|---|---|
| ***F24F 6/04*** | (2006.01) |
| ***A24F 25/02*** | (2006.01) |
| ***F24F 11/30*** | (2018.01) |
| *F24F 6/00* | (2006.01) |
| *F24F 110/20* | (2018.01) |

(52) U.S. Cl.

CPC ..... *F24F 6/043* (2013.01); *A24F 25/02* (2013.01); *F24F 11/30* (2018.01); *F24F 2006/008* (2013.01); *F24F 2110/20* (2018.01)

(58) Field of Classification Search

CPC ..... F24F 6/043; F24F 11/30; F24F 2110/20; F24F 2006/008; A24F 25/02

USPC ..... 261/65, 99, 104, 107, DIG. 34, DIG. 41

See application file for complete search history.

(56) References Cited

U.S. PATENT DOCUMENTS

| | | | | | |
|---|---|---|---|---|---|
| 888,393 | A * | 5/1908 | Dunning | | |
| 1,718,182 | A * | 6/1929 | Rose | F24F 6/043 | 126/113 |
| 1,729,119 | A * | 9/1929 | Odean | F24D 5/00 | 237/78 R |
| 1,888,387 | A * | 11/1932 | Killing | F24F 6/043 | 200/82 R |
| 2,095,451 | A * | 10/1937 | Reynolds | F24F 6/043 | 261/103 |
| 2,188,708 | A * | 1/1940 | Davis | A47B 77/08 | 261/104 |
| 2,432,736 | A * | 12/1947 | Elkins | A24F 25/02 | 239/55 |
| 5,400,612 | A * | 3/1995 | Hedges | F24F 6/043 | 62/171 |
| 5,403,233 | A * | 4/1995 | Daneshvar | F24F 6/043 | 237/78 R |
| 5,771,845 | A * | 6/1998 | Pistien | F22B 1/00 | 122/366 |
| 6,168,140 | B1 * | 1/2001 | Akazawa | F24F 6/043 | 261/80 |
| 2011/0163464 | A1 * | 7/2011 | Hamada | B60H 3/022 | 261/104 |

* cited by examiner

*Primary Examiner* — Charles S Bushey

(74) *Attorney, Agent, or Firm* — Changi Wu; Law Office of Changi Wu

(57) ABSTRACT

A moisture delivery apparatus comprises a liquid reservoir with liquid, a plurality of wicks, an enclosure with panels, and a supporting and adjusting structure for supporting and adjusting the body of the plurality of wicks to emit more or less of vapor of the liquid into the enclosure to provide moisture, wherein the supporting and adjusting structure may be injectors, stanchion, baffles, and fasteners on panels.

11 Claims, 7 Drawing Sheets

HUMIDITY DELIVERY METHOD AND APPARATUS

CROSS-REFERENCE RELATED TO RELATED APPLICATIONS

This application claims the benefit and the priority of U.S. Provisional Application No. 62/219,348, filed Sep. 16, 2015, which is hereby incorporated herein by reference in its entirety.

BACKGROUND

Many materials, including wood, fabric, paper, photographs, books, plants, food items, canvas and paint, are sensitive to levels of moisture in the environment that may alter their moisture content and result in degradation over time. High levels of humidity may result in swelling or expansion of the materials, while low levels of humidity may result in shrinkage or contraction. The level of degradation may be exacerbated by the degree and rate of change in relative humidity, where large and rapid fluctuations may result in more degradation than small and gradual fluctuations in expansion and contraction.

Tobacco leaves used to fabricate cigars may dry out, crack and fall apart over time when exposed to improper or fluctuating humidity levels. Cigars, cigarettes, pipe tobacco or cannabis products may be stored in humidors to maintain a desired relative humidity. For tobacco products, the desired relative humidity may be in the 70% range, while cannabis products may be stored at lower relative humidity. For tobacco products, a humidity level that is too low may cause tobacco products to dry out, while high humidity may promote the hatching of pests, such as tobacco beetles, or the formation of mold. Humidors are generally constructed of wood or glass, available in a variety of sizes, and may contain from a few to several thousand cigars. The humidity level inside a humidor may be maintained using distilled water in an electronic humidifier or moisture sources such as silica gel beads or sponges. Propylene glycol may be added to the distilled water to aid in controlling to the desired humidity level, and a mild antifungal or antibacterial agent may be added to prevent mold growth that may breed bacteria and fungi. These agents may cause an unpleasant taste of tobacco and cannabis products when smoked.

Wood used to fabricate musical instruments or pool cues, may shrink in dry climates, and in colder climates when home heaters are in use, while excessive humidity over time in moist climates may result in the swelling of these items. Improper or fluctuating humidity levels may ruin the sound, playability, tune-ability, and value of wood instruments, through warping, cracking and splitting. Dried wood on a guitar fret board may retract around the metal fret wires The ideal year round relative humidity is generally accepted by guitar manufacturers and resellers to be in the 50% range. Many guitar manufacturers and resellers recommend storing an instrument in its case when not in use, along with a humidity device for dry environments or dehumidity device for wet environments. Numerous humidity and dehumidity devices exist in the market, some designed to be inserted in the sound hole of an acoustic guitar and others to be placed inside the case. Humidity devices may dry out over time requiring periodic replacement or recharging in order to continue emitting vapor. Dehumidifying devices, such as dessicants and silica gel packs may become saturated over time requiring periodic replacement or drying out to continue absorbing vapor.

The air-tightness of a case's seal depends on its quality and design. Considerable variation is observed in studies of different cases where dry ice is used to show how much water vapor escapes from cases when latched closed. Another way to infer the sealing integrity of a case is by how long a humidity or dehumidity device lasts. The leakier the case the quicker a humidity device dries up, or a dehumidity device becomes saturated with moisture. A wood musical instrument stored inside a tight-fitting case where it makes physical contact on most of the instrument's surfaces, such as back and sides, may inhibit moisture from uniformly reaching surfaces. This may result in a humidity gradient that damages the instrument from humidified areas swelling while areas that are not humidified shrink. Additionally, materials used in the construction of some case liners may have hygroscopic properties that draw moisture away from the instrument and humidity devices.

Room humidifiers used in dry environments may not adequately control in the desired relative humidity range and may require regular maintenance including daily refilling of the water source and periodic cleaning. These humidifiers may also create condensation on cooler room surfaces, promoting mold growth that can breed bacteria and fungi inside the humidifier. Room humidifiers may also disperse a fine white dust from minerals and impurities in tap water. Mold growth and fine white dust may contribute to health issues, such as allergies. Warm mist humidifiers also increase the risk of a steam burn. If a room humidifier runs out of water, the device will stop working which may result in a sudden change in humidity causing harm to items inside the room.

Room dehumidifiers used in wet environments may not adequately control in the desired relative humidity range. Dehumidifiers may require regular maintenance, or the installation of a drain line to empty the accumulated water, and may also create room noise, heat, and increased energy bills. If a dehumidifier fills with water, the device will stop working which may result in a sudden change in humidity causing harm to stored items.

Home humidifiers and dehumidifiers may be used, but suffer from some of the same drawbacks as their room counterparts, may cost thousands of dollars, and require costly professional installation and regular maintenance.

Another method for storing one or more wood instruments or devices is in a humidity controlled and dust free cabinet or case. These cabinets or cases can be expensive, costing thousands of dollars, and may require considerable floor space. Therefore, there is a long felt need to resolve the above issues.

BRIEF SUMMARY OF THE INVENTION

This Brief Summary is included so as to introduce, in an abbreviated form, various topics to be elaborated upon below in the Detailed Description. This Brief Summary is not intended to identify key or essential aspects of the claimed invention. This Brief Summary is similarly not intended for use as an aid in determining the scope of the claims. The current invention overcomes the aforementioned issues. The current invention is directed to a moisture delivery apparatus, comprising a liquid reservoir with liquid, a plurality of wicks, an enclosure with panels, and a supporting and adjusting structure for supporting and adjusting the body of the plurality of wicks to emit more or less of vapor of the liquid into the enclosure to provide moisture, wherein the supporting and adjusting structure may be injectors, stanchion, baffles, and fasteners on panels.

BRIEF DESCRIPTION OF THE DRAWINGS

It should be understood that the drawings are merely representative, are not necessarily drawn to scale, and are not intended to limit the subject matter of this application.

DETAILED DESCRIPTION

Figure 1:
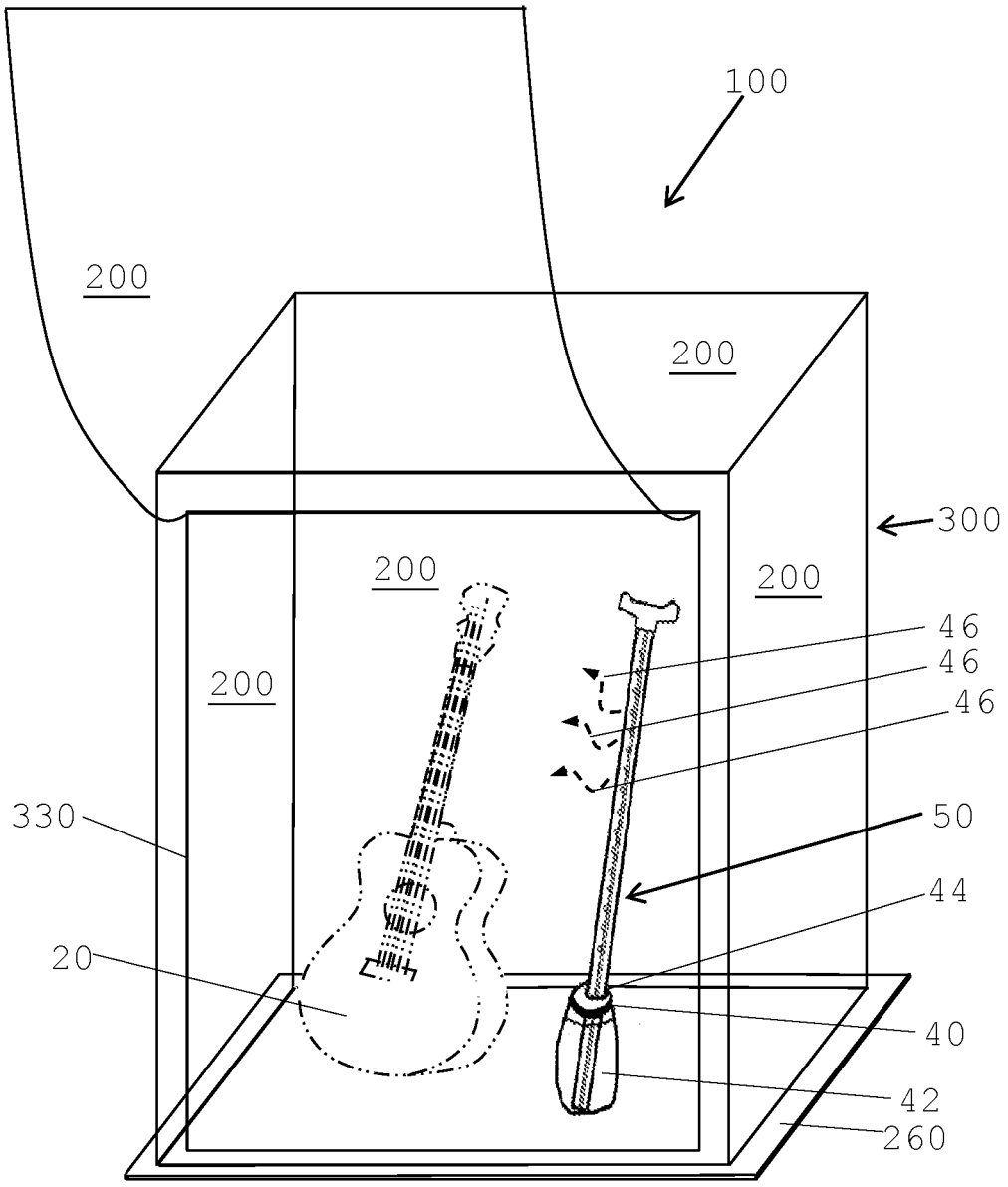
FIG. 1 is a perspective view of one embodiment of the moisture delivery apparatus with injectors as the supporting and adjusting structure.
Figure 2:
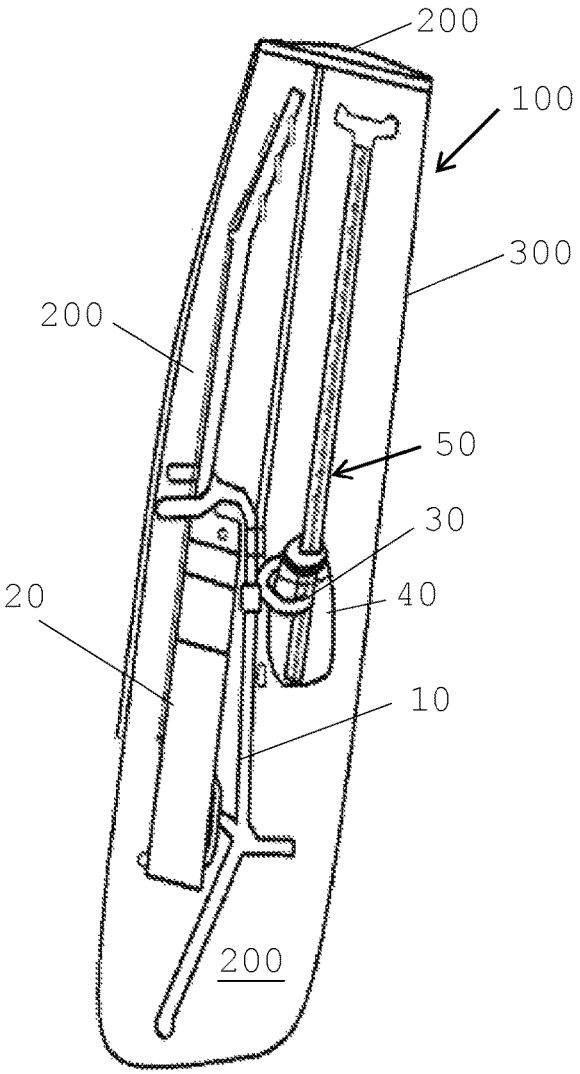
FIG. 2 is one perspective view of another embodiment of the moisture delivery apparatus with injectors as the supporting and adjusting structure.
Figure 2A:
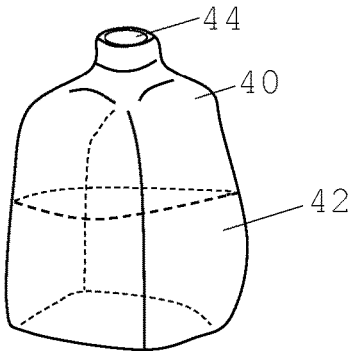
FIG. 2A is one perspective view of another embodiment of the liquid reservoir for the moisture delivery apparatus with injectors as the supporting and adjusting structure.

Before the present invention is described in greater detail, it is to be understood that this invention is not limited to particular embodiments described, and as such may, of course, vary. It is also to be understood that the terminology used herein is for the purpose of describing particular embodiments only, and is not intended to be limiting, since the scope of the present invention will be limited only by the appended claims.

Where a range of values are provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed within the invention. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included in the invention.

Other than in the embodiment or example, or where indicated otherwise, all numbers indicating ingredient quantities and/or reaction conditions are to be understood as being modified in every instance by the word "about," which means the ingredient quantities or reaction conditions are within 10 percent to 15 percent of the indicated value.

Unless defined otherwise, all terms used herein have the same meaning as commonly understood by one of ordinary skill in the art to which this invention belongs. Although any methods and materials similar or equivalent to those described herein can be used in the practice or testing of the present invention, some potential and exemplary methods and materials may now be described. Any and all publications mentioned herein are incorporated herein by reference to disclose and describe the methods and/or materials in connection with which the publications are cited. It is understood that the present disclosure supersedes any disclosure of an incorporated publication to the extent there is a contradiction.

It must be noted that as used herein and in the appended claims, the singular forms "a", "an", and the may also include the plural referents unless the context clearly dictates otherwise.

It is further noted that the claims may be drafted to exclude any element that may be optional. As such, this statement is intended to serve as antecedent basis for use of such exclusive terminology as "solely", "only" and the like in connection with the recitation of claim elements, or the use of a "negative" limitation.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention.

The current invention is directed to a storage enclosure and humidity delivery method and apparatus for maintaining materials, such as wood, fabric, paper, canvas and paint, in a humidified environment will now be described with reference to the included drawing figures. It should be understood that the drawings are merely representative, are not necessarily drawn to scale, and are not intended to limit the subject matter of this application.

Referring now to FIG. 1, FIG. 2, FIG. 2A, FIG. 3, FIG. 3A and FIG. 3B, one of the embodiments of the moisture delivery apparatus 100 comprises a liquid reservoir 40, wherein the liquid reservoir 40 further comprises a liquid 42 and an access 44 to the liquid 42; a plurality of wicks 80, wherein each of the plurality of wicks 80 further comprises a first end 81, a second end 82 opposite to the first end 81, and a body 83 extending from the first end 81 to the second end 82; a supporting and adjusting structure 50 for supporting and adjusting the body 83 of the plurality of wicks 80, wherein the first portion 84 of the body 83 of the plurality of wicks 80 is submerged in the liquid 42 inside the liquid reservoir 40, wherein a second portion 85 of the body 83 of the plurality of wicks 80 is above the liquid 42, wherein the supporting and adjusting structure 50 supports the plurality of wicks 80 to extend above said liquid reservoir 40, wherein the first portion 84 of the body 83 of the plurality of wicks 80 draws the liquid 42 from the liquid reservoir 40 to second portion 85 of the body 83 of the plurality of wicks 80, and wherein a vapor 46 of the liquid 42 is emitted from the second portion 85 of the body 83 of the plurality of wicks 80; and an enclosure 300, wherein the enclosure 300 comprises a plurality of panels 200 forming the enclosure 300, wherein the enclosure 300 further comprises an access 330 formed on one of the plurality of panels 200, wherein an object 20, such as a guitar, can ingress into or egress out of the enclosure 300 through the access 330, wherein the enclosure 300 can stand on the plurality of panels 200, and wherein a relative humidity occurs inside the enclosure 300. The panels 200 can be rigid or flexible with frames. The object 20 can stand alone or be supported by a stand 10 with a holder 30 to hold up the liquid reservoir 40. However, the liquid reservoir 40 can stand alone too. The liquid 42 can be water, electrolyte, or solutions. The liquid 42 is delivered from the first portion 84 to second portion 85. The vapor 46 of the liquid 42 is emitted from the second portion 85 of the plurality of wicks 80 when the wicks 80 are exposed to air in the enclosure 300. The more exposure of the wicks 80 to the air, the more vapor 46 will be emitted to increase the relative humidity until air inside the enclosure 300 is saturated. The wicks 80 are braided fibers made of the material such as but not limited to cotton, wool, flax, hemp, or artificial fibers. The panels 200 on the access 330 can be a flexible, clear material attached on other panels 200, such as PVC sheet and Polyethylene sheet having one side attached to other panels; or rigid materials hinged with other panels 200, such as plastic plate with hinges onto other panels 200. The plurality of panels of the enclosure 300 can also be plastic bag having flexible, clear material.

Figure 3:
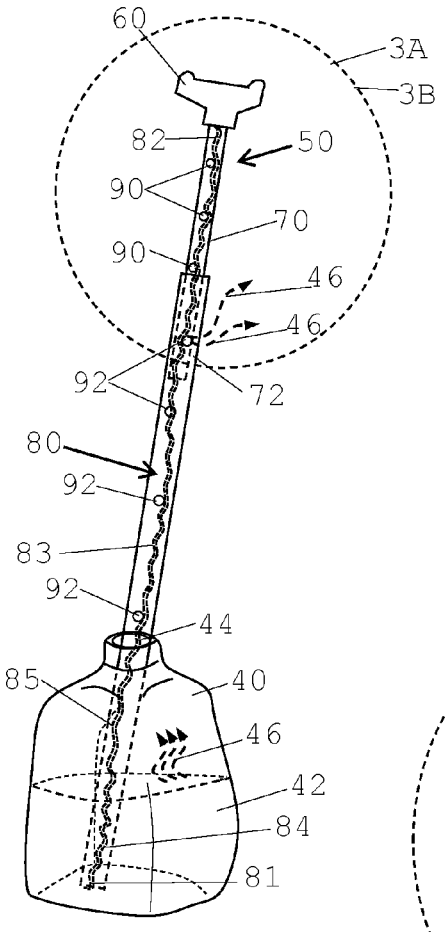
FIG. 3 is a frontal view of one embodiment of the moisture delivery apparatus with injectors as the supporting and adjusting structure.
Figure 3A:
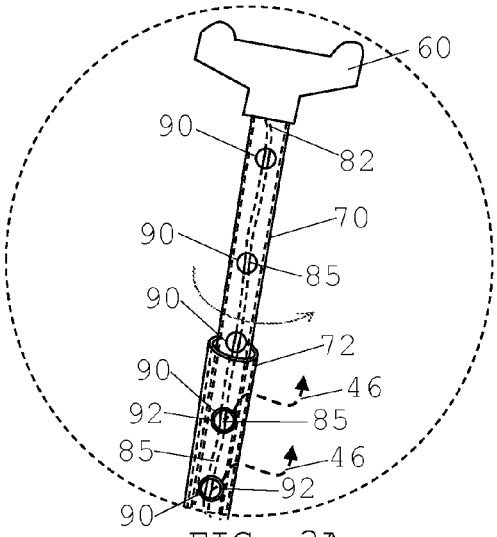
FIG. 3A is a close-up perspective view of one embodiment of the moisture delivery apparatus with injectors when perforations are aligned.
Figure 3B:
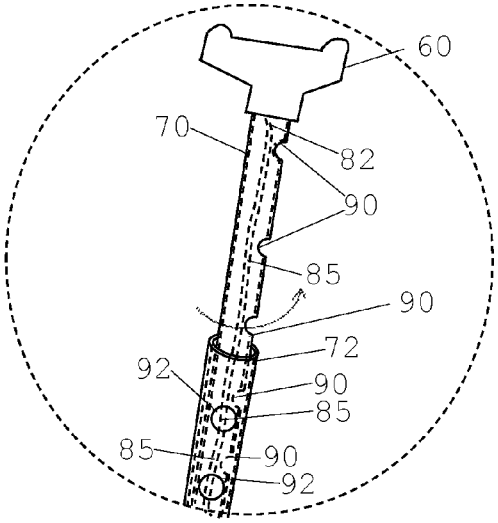
FIG. 3B is a close-up perspective view of one embodiment of the moisture delivery apparatus with injectors when perforations are not aligned.

Referring to FIG. 3, FIG. 3A, and FIG. 3B for illustration of one of the embodiments of the current invention, the supporting and adjusting structure 50 comprises an outer injector 72 and an inner injector 70, wherein the outer injector 72 is in a tubular shape, wherein the inner injector 70 is in a tubular shape, wherein the outer injector 72 is disposed in the enclosure 300, wherein the inner injector 70 is disposed inside the outer injector 72, wherein the second end 82 of each of the plurality of wicks 80 is inside the inner injector 70, wherein the inner injector 70 is relatively movable and rotatable to the outer injector 72, wherein a plurality of perforations 92 are formed on the outer injector 72, wherein a plurality of perforations 90 are formed on the inner injector 70, wherein the inner injector 70 can be rotated and/or moved to cause the plurality of perforations 90 on the inner injector 70 aligning with the plurality of perforations 92 on the outer injector 72 (FIG. 3A), and wherein the inner injector 70 can be rotated and/or moved to cause the plurality of perforations 90 on the inner injector 70 not aligning with the plurality of perforations 92 on the outer injector 72 (FIG. 3B).

Also referring to FIG. 3, FIG. 3A, and FIG. 3B, one of the embodiments of the current invention shows an optional knob 60 is attached to the inner injector 70 for the convenience to turn and adjust the inner injector 70. The supporting and adjusting structure 50 is operated by rotating the inner injector 70 to align, or misalign, perforations 90 of inner injector 70 relative to outer injector 72 to regulate the release of vapor 46. The inner injector 70 may be rotated or slid inside outer injector 72 to align or misalign perforations 90 with perforations 92 to regulate release of vapor 46. The shape of the perforations 90 and the perforations 92 can be circle, square, rectangular, or other shapes.

Figure 4:
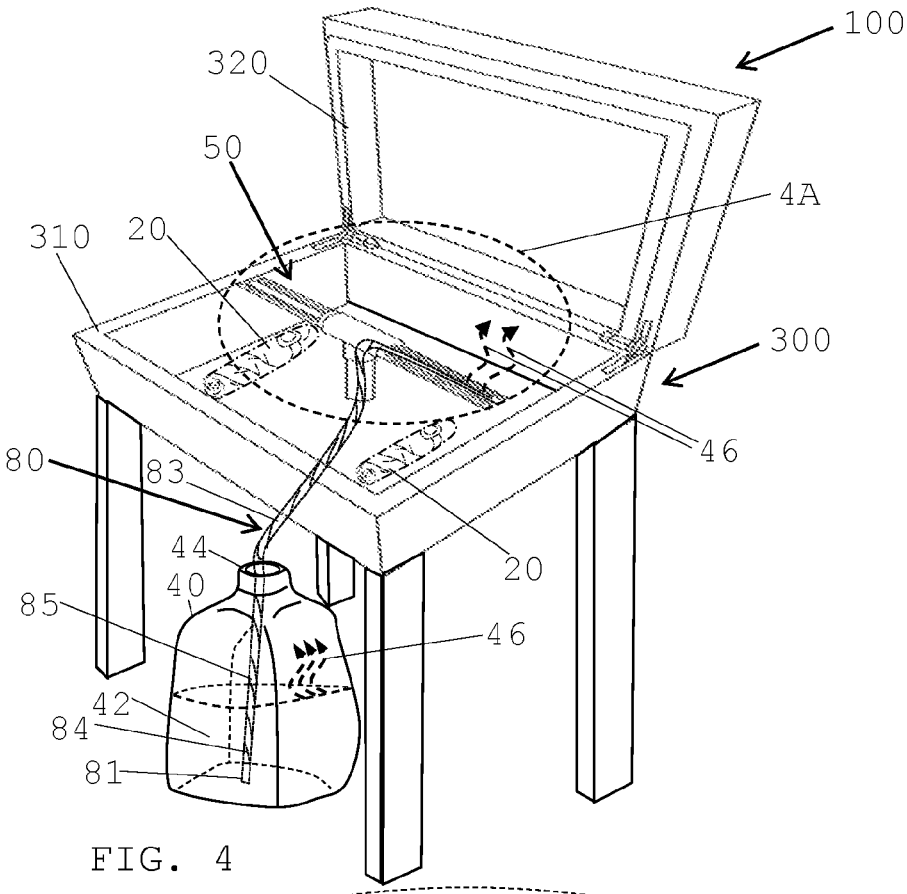
FIG. 4 is a perspective view of another embodiment of the moisture delivery apparatus with injectors as the supporting and adjusting structure.
Figure 4A:
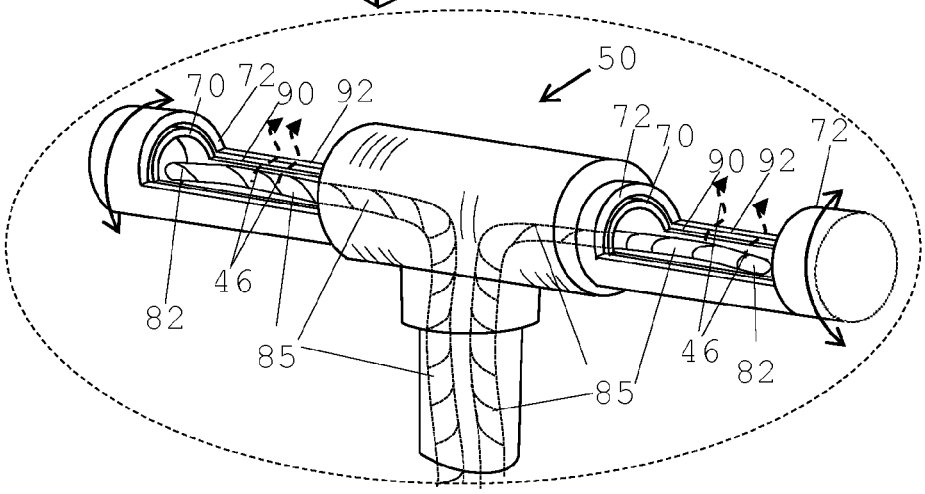
FIG. 4A is a close-up perspective view of the supporting and adjusting structure of another embodiment of the moisture delivery apparatus.

Referring to FIG. 4 and FIG. 4A, one of the embodiments of the moisture delivery apparatus 100 comprises a liquid reservoir 40, wherein the liquid reservoir 40 further comprises a liquid 42 and an access 44 to the liquid 42; a plurality of wicks 80, wherein each of the plurality of wicks 80 further comprises a first end 81, a second end 82 opposite to the first end 81, and a body 83 extending from the first end 81 to the second end 82; a supporting and adjusting structure 50 for supporting and adjusting the body 83 of the plurality of wicks 80, wherein the first portion 84 of the body 83 of the plurality of wicks 80 is submerged in the liquid 42 inside the liquid reservoir 40, wherein a second portion 85 of the body 83 of the plurality of wicks 80 is above the liquid 42, wherein the supporting and adjusting structure 50 supports the plurality of wicks 80 to extend above said liquid reservoir 40, wherein the first portion 84 of the body 83 of the plurality of wicks 80 draws the liquid 42 from the liquid reservoir 40 to second portion 85 of the body 83 of the plurality of wicks 80, and wherein a vapor 46 of the liquid 42 is emitted from the second portion 85 of the body 83 of the plurality of wicks 80; and an enclosure 300, wherein the enclosure 300 further comprises a receptacle 310 having a lid 320, wherein the lid 320 can be opened or closed on the receptacle 310, wherein the supporting and adjusting structure 50 is disposed inside the enclosure 300, wherein a relative humidity is inside the enclosure 300, wherein the moisture delivery apparatus 100 will emit a vapor 46 from the second portion 85 of the plurality of wicks 80 to moisturize the relative humidity inside the enclosure 300. The wicks 80 are braided fibers made of cotton, wool, flax, hemp, or artificial fibers.

Also referring to FIG. 4 and FIG. 4A, in one preferred embodiment of the current invention, the supporting and adjusting structure 50 further comprises an outer injector 72 and an inner injector 70, wherein the outer injector 72 is in a tubular shape, wherein the inner injector 70 is in a tubular shape, wherein the outer injector 72 is disposed in the enclosure 300, wherein the inner injector 70 is disposed inside the outer injector 72, wherein the second end 82 of each of the plurality of wicks 80 is inside the inner injector 70, wherein the outer injector 72 is relatively movable and rotatable to the inner injector 70, wherein a plurality of perforations 92 are formed on the outer injector 72, wherein a plurality of perforations 90 are formed on the inner injector 70, wherein the outer injector 72 can be rotated and/or moved to cause the plurality of perforations 92 on the outer injector 72 aligning with the plurality of perforations 90 on the inner injector 70, and wherein the outer injector 72 can be rotated and/or moved to cause the plurality of perforations 92 on the outer injector 72 not aligning with the plurality of perforations 90 on the inner injector 70. The vapor 46 is emitted from the second portion 85 of the body 83 of the plurality of wicks 80 into the enclosure 300 to adjust the relative humidity inside the enclosure 300.

Figure 5:
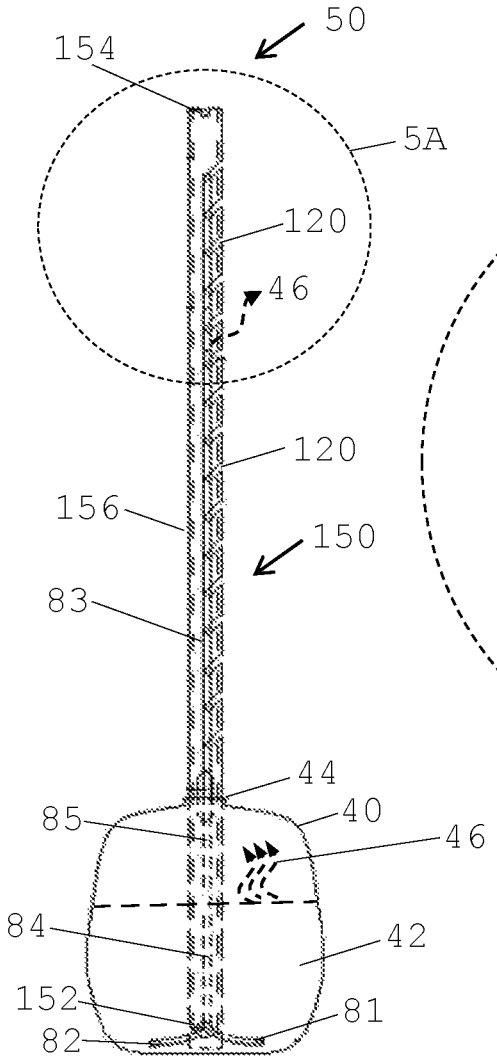
FIG. 5 is a frontal view of another embodiment of the moisture delivery apparatus with stanchion as the supporting and adjusting structure.
Figure 5A:
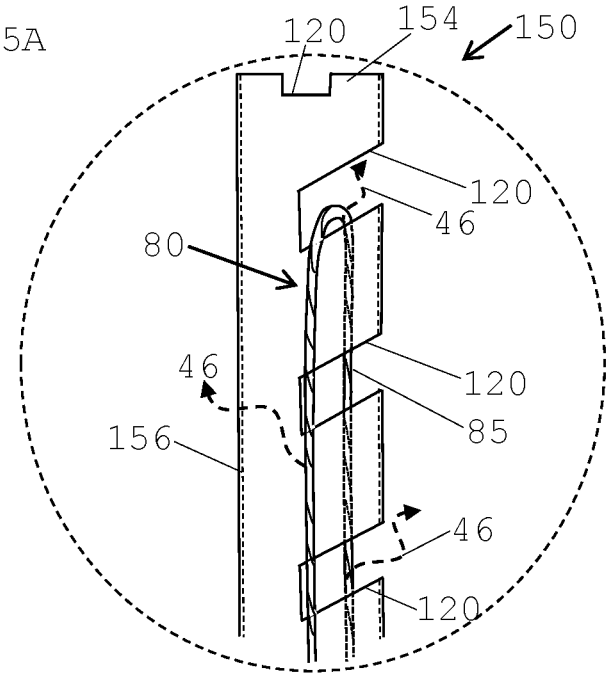
FIG. 5A is a close-up frontal view of another embodiment of the moisture delivery apparatus with stanchion as the supporting and adjusting structure.
Figure 5B:
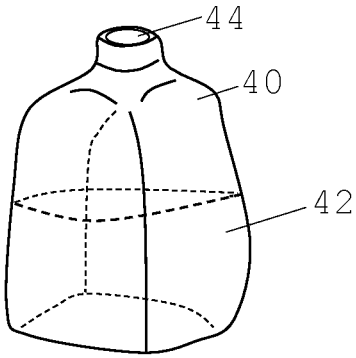
FIG. 5B is a perspective view of the liquid reservoir of another embodiment of the moisture delivery apparatus.

Referring to FIG. 5, FIG. 5A, and FIG. 5B for illustration of one of the embodiments of the current invention, the supporting and adjusting structure 50 comprises a stanchion 150 having a first end 152, a second end 154, an extended member 156 between the first 152 end and the second end 154, and a plurality of notches 120 formed on the extended member 156, and a plurality of notches 120 formed on the extended member 156, wherein the first end 152 of the stanchion 150 is disposed in the liquid reservoir 40, wherein the second end 154 of the stanchion 150 is extended above the liquid reservoir 40, and wherein the second portion 85 of the body 83 of the plurality of wicks 80 is adjustable to be disposed on any one of the plurality of notches 120 above the liquid 42 of the liquid reservoir 40. The vapor 46 is emitted from the second portion 85 of the body 83 of the plurality of wicks 80. The longer the second portion 85 exposed above the liquid 42, the more vapor 46 is emitted from the plurality of wicks 80 into the enclosure 300 until the air is saturated.

Figure 6:
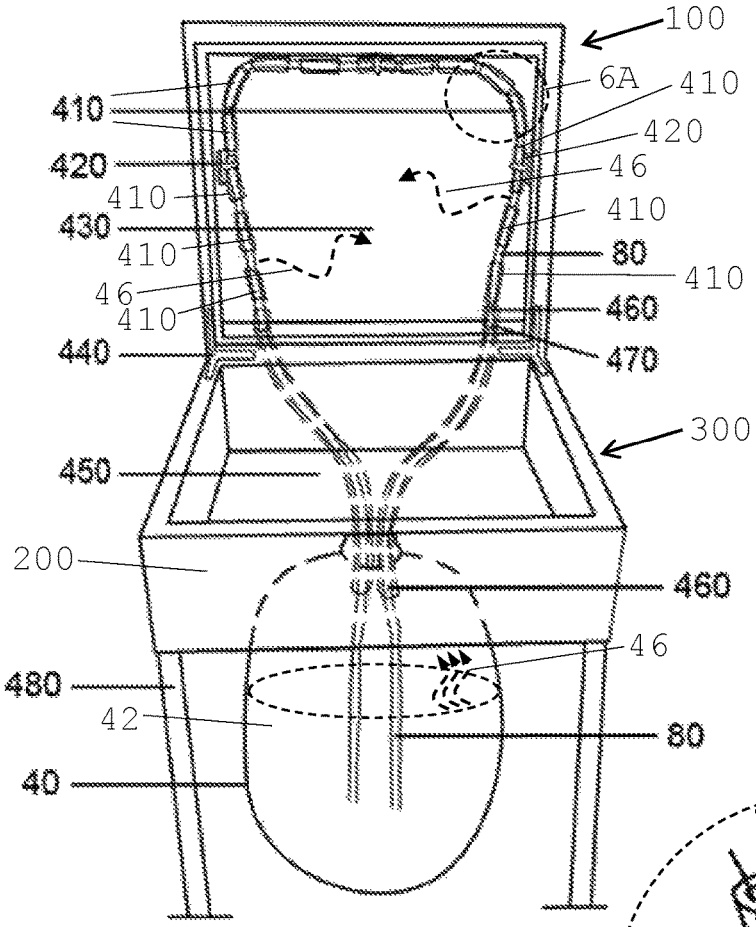
FIG. 6 is a perspective view of another embodiment of the moisture delivery apparatus with baffles as the supporting and adjusting structure.
Figure 6A:
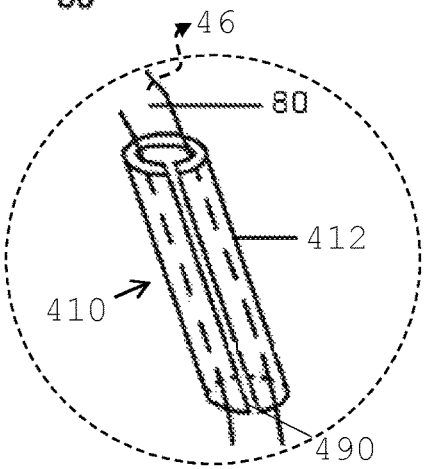
FIG. 6A is a detail view of the baffle of another embodiment of the moisture delivery apparatus with baffles as the supporting and adjusting structure.
Figure 6B:
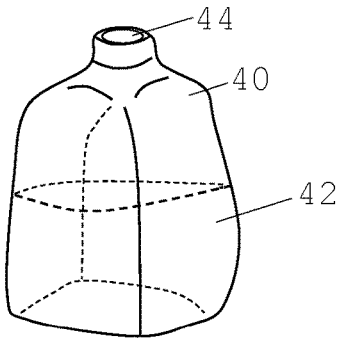
FIG. 6B is one perspective view of another embodiment of the liquid reservoir for the moisture delivery apparatus with baffles as the supporting and adjusting structure.

Referring to FIG. 6, FIG. 6A, and FIG. 6B, for illustration of one of the embodiments of the current invention, the supporting and adjusting structure 50 comprises a plurality of baffles 410 wherein each of the plurality of baffles 410 comprises a tubular member 412 with a slit 490 formed longitudinally on the tubular member 412, wherein each of the plurality of baffles 410 can be attached to or detached from the plurality of wicks 80 through the slit 490, wherein the plurality of baffles 410 covers a portion of the second portion 85 of the plurality of wicks 80 when the plurality of baffles 410 are attached to the plurality of wicks 80, and wherein the plurality of baffles 410 uncover a portion the second portion 85 of the plurality of wicks 80 when the plurality of baffles 410 are detached from the plurality of wicks 80. The more the plurality of baffles 410 are attached to the plurality of wicks 80, the less second portion 85 of the plurality of wicks 80 is exposed to the air, and as a result, less vapor 46 is emitted to the enclosure 300 and add less relative humidity to the enclosure 300. Reversely, less the plurality of baffles 410 are attached to the plurality of wicks 80, the more second portion 85 of the plurality of wicks 80 is exposed to the air, and as a result, more vapor 46 is emitted to the enclosure 300 and increase more relative humidity to the enclosure 300 until air inside the enclosure 300 is saturated.

Also referring to FIG. 6, FIG. 6A, and FIG. 6B, another one of the embodiments of the current invention has enclosure 300 as a cigar humidor. The one embodiment of the current invention comprises a plurality of panels 200 that includes at least a base panel 450 and lid panel 430 connected with hinges 440. A tubing 460 can be optionally inserted into backside of lid panel 430 through holes 470 to liquid reservoir 40. A plurality of wicks 80 is disposed in tubing 460 and the first portion 84 of the plurality of wicks 80 is in liquid reservoir 40 to draw liquid 42 and deliver the liquid 42 to the second portion 85 of the plurality of wicks 80. The plurality of baffles 410 are attached to the plurality of wicks 80 and held in place by fasteners 420 mounted to the plurality of panels 200. The plurality of baffles 410 may be constructed of sections of tubes for the tubular member 412, that the plurality of baffles 410 can be attached, snapped, or clipped on the plurality of wicks 80. A plurality of stands 480 is optional to support the enclosure 300. In one embodiment of the current invention working as a humidor, the plurality panels 200 are made of plants, woods, paper, plastics, or metal.

Figure 7:
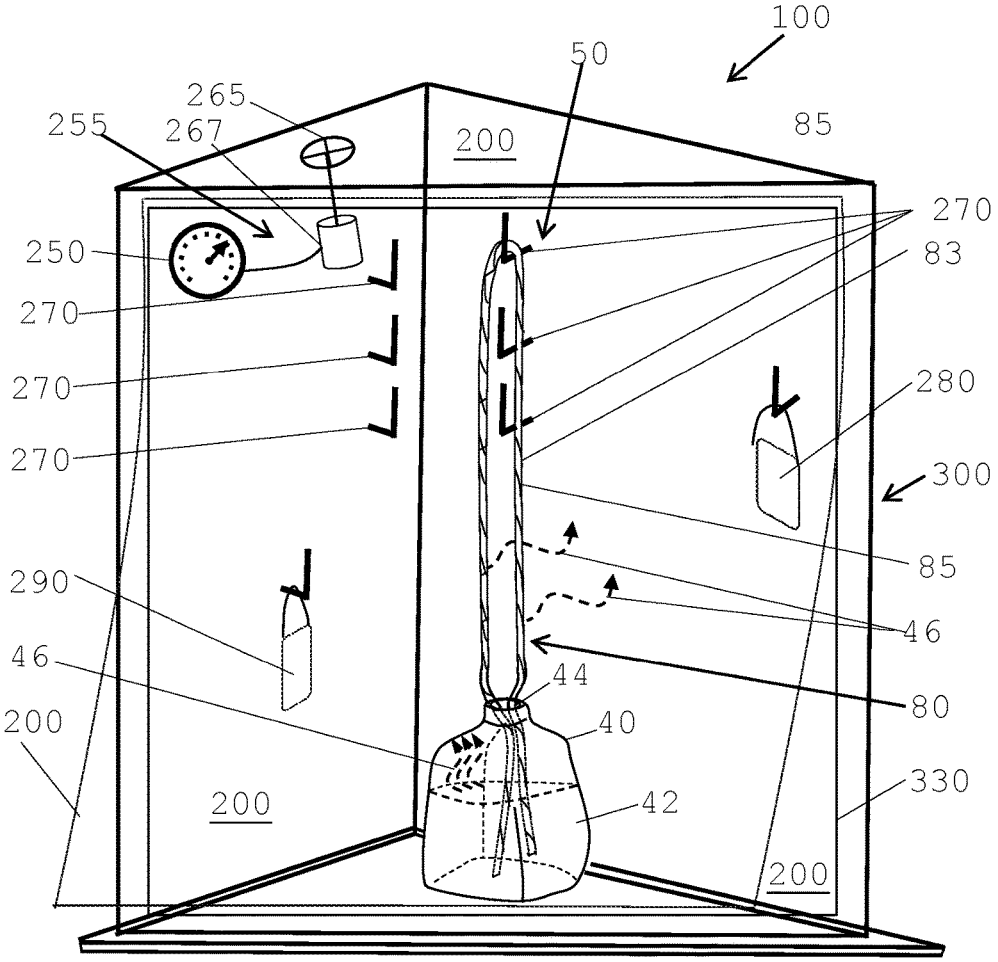
FIG. 7 is a perspective view of another embodiment of the moisture delivery apparatus with fasteners on panels as the supporting and adjusting structure.

Referring now to FIG. 7, in an illustration of one of the embodiments of the current invention, the supporting and adjusting structure 50 comprises a plurality of fasteners 270, wherein the plurality of fasteners 270 are mounted to the plurality of panels 200 of the enclosure 300, wherein the second portion 85 of the body 83 of the plurality of wicks 80 can be disposed on the plurality of fasteners 270 to adjust the length of the second portion 85 of the plurality of wicks 80, and wherein the second portion 85 of the body 83 of the plurality of wicks 80 can be undisposed from the plurality of fasteners 270. The longer the second portion 85 of the plurality of wicks 80 is exposed to air, the more vapor 46 will be emitted to air inside the enclosure 300 to increase the relative humidity in the enclosure 300 until the relative humidity is saturated.

Also referring to FIG. 7, one embodiment of the enclosure 300 comprising a plurality of panels 200 can be constructed as the illustration shows. The plurality of panels 200 can be hinged or creased to free stand. The plurality of panels 200 may be constructed of a translucent or transparent materials, such as but not limited to clear PVC, clear HDPE, plastic, glass, to make the contents of enclosure 300 visible from the outside. A hygrometer 250 may be mounted to the one of the plurality of panels 200 to measure the humidity level inside enclosure 300. A vent 265 are formed on one or more of the plurality of panels 200 to allow outside air into, or allow inside air or vapor 46 to escape from enclosure 300. A base pad 260 may be placed underneath enclosure 300 to prevent the relative humidity from the moisture absorption effect by the floor material, such as carpet or fabrics. An embodiment of moisture buffering material 280 may be sponges, polymers, and cotton fabric or other fibrous material. An embodiment of a dehumidifying device 290 may be a desiccant.

Also referring to FIG. 7, in one embodiment of the current invention, the moisture delivery apparatus 100 further comprises at least one ventilation system 255, wherein the at least one ventilation system 255 comprises at least a vent 265, a controller 267, at least one hygrometer 250 disposed inside the enclosure 300, wherein the controller 267 is interfaced with the at least one hygrometer 250, wherein the controller 267 can open the at least one vent 265 when the relative humidity in the enclosure 300 is above a predetermined level set in at least one hygrometer 250, and wherein the controller 267 can close the at least one vent 265 when the relative humidity in the enclosure 300 is below a predetermined level set in at least one hygrometer 250.

The advantages of a subject matter of this application include, without limitation, a way to store, display and protect items, such as wood instruments or devices inside a humidity controlled enclosure allowing quick access to the items.

While the foregoing written description of the subject matter of this application enables one of ordinary skill to make and use what is considered presently to be the best mode thereof, those of ordinary skill will understand and appreciate the existence of variations, combinations, and equivalents of the specific embodiment, method, and examples herein. The subject matter of this application should therefore not be limited by the above described embodiments, methods, and examples, but by all embodiments and methods within the scope and spirit of the subject matter of this application.

What is claimed is:

1. A moisture delivery apparatus, comprising:

a liquid reservoir, wherein said liquid reservoir further comprises a liquid and an access to said liquid;

a plurality of wicks, wherein each of said plurality of wicks further comprises a first end, a second end opposite to said first end, and a body extending from said first end to said second end, wherein said body further comprises a first portion and a second portion, wherein said first portion of said body of said plurality of wicks is submerged in said liquid inside said liquid reservoir, wherein said second portion of said body of said plurality of wicks is above said liquid, wherein said first portion of said body of said plurality of wicks draws said liquid from said liquid reservoir to second portion of said body of said plurality of wicks, and wherein a vapor of said liquid is emitted from said second portion of said body of said plurality of wicks;

a supporting and adjusting structure for supporting and adjusting said body of said plurality of wicks, and wherein said supporting and adjusting structure supports said plurality of wicks to extend above said liquid reservoir;

an enclosure, wherein said enclosure comprises a plurality of panels forming said enclosure, wherein said enclosure further comprises an access formed on one of said plurality of panels, wherein an object can ingress into or egress out of said enclosure through said access, wherein said enclosure can stand on said plurality of panels, and wherein a relative humidity occurs inside said enclosure; and wherein said supporting and adjusting structure further comprises a plurality of fasteners, wherein said plurality of fasteners may be mounted to said plurality of panels of said enclosure, wherein said second portion of said body of said plurality of wicks can be disposed on said plurality of fasteners to adjust a length of said second portion of said plurality of wicks, and wherein said second portion of said body of said plurality of wicks can be undisposed from said plurality of fasteners.

2. The moisture delivery apparatus of claim 1, further comprising a base pad under said enclosure.

3. The moisture delivery apparatus of claim 1, wherein said supporting and adjusting structure further comprises an outer injector and an inner injector, wherein said outer injector is in a tubular shape, wherein said inner injector is in a tubular shape, wherein said outer injector is disposed in said enclosure, wherein said inner injector is disposed inside said outer injector, wherein said second end of each of said plurality of wicks is inside said inner injector, wherein said inner injector is relatively movable and rotatable to said outer injector, wherein a plurality of perforations are formed on said outer injector, wherein a plurality of perforations are formed on said inner injector, wherein said inner injector can be rotated and/or moved to cause said plurality of perforations on said inner injector aligning with said plurality of perforations on said outer injector, and wherein said inner injector can be rotated and/or moved to cause said plurality of perforations on said inner injector not aligning with said plurality of perforations on said outer injector.

4. The moisture delivery apparatus of claim 1, wherein said supporting and adjusting structure further comprises a stanchion having a first end, a second end, an extended member between said first end and said second end, and a plurality of notches formed on said extended member, wherein said first end of said stanchion is disposed in said liquid reservoir, wherein said second end of said stanchion is extended above said liquid reservoir, and wherein said second portion of said body of said plurality of wicks is adjustable to be disposed on any one of said plurality of notches above said liquid of said liquid reservoir.

5. The moisture delivery apparatus of claim 1, further comprising a dehumidifying device disposed inside said enclosure, and wherein said dehumidifying device can absorb a moisture inside said enclosure.

6. The moisture delivery apparatus of claim 1, further comprising a moisture buffering material disposed inside said enclosure, and wherein said moisture buffering material can absorb a moisture inside said enclosure.

7. The moisture delivery apparatus of claim 1, further comprising at least one hygrometer disposed inside said enclosure.

8. The moisture delivery apparatus of claim 1, further comprising at least one vent, wherein said at least one vent can be open or closed manually for adjusting said relative humidity inside said enclosure.

9. The moisture delivery apparatus of claim 1, further comprising at least one ventilation system, wherein said at least one ventilation system comprises at least a vent, a controller, at least one hygrometer disposed inside said enclosure, wherein said controller is interfaced with said at least one hygrometer, wherein said controller can open said at least one vent when said relative humidity in said enclosure is above a predetermined level set in at least one hygrometer, and wherein said controller can close said at least one vent when said relative humidity in said enclosure is below a predetermined level set in at least one hygrometer.

10. A moisture delivery apparatus, comprising:

a liquid reservoir, wherein said liquid reservoir further comprises a liquid and an access to said liquid;

a plurality of wicks, wherein each of said plurality of wicks further comprises a first end, a second end opposite to said first end, and a body extending from said first end to said second end, wherein said body further comprises a first portion and a second portion, wherein said first portion of said body of said plurality of wicks is submerged in said liquid inside said liquid reservoir, wherein said second portion of said body of said plurality of wicks is above said liquid, wherein said first portion of said body of said plurality of wicks draws said liquid from said liquid reservoir to second portion of said body of said plurality of wicks, and wherein a vapor of said liquid is emitted from said second portion of said body of said plurality of wicks;

an enclosure, wherein said enclosure further comprises a receptacle and a lid, and wherein said lid can be opened or closed on said receptacle; and a supporting and adjusting structure further comprises an outer injector and an inner injector, wherein said outer injector is in a tubular shape, wherein said inner injector is in a tubular shape, wherein said outer injector is disposed inside said enclosure, wherein said inner injector is disposed inside said outer injector, wherein said second end of each of said plurality of wicks is inside the inner injector, wherein said outer injector is relatively movable and rotatable to said inner injector, wherein a plurality of perforations are formed on said outer injector, wherein a plurality of perforations are formed on said inner injector, wherein said outer injector can be rotated and/or moved to cause said plurality of perforations on said outer injector aligning with said plurality of perforations on said inner injector, and wherein said outer injector can be rotated and/or moved to cause said plurality of perforations on said outer injector not aligning with said plurality of perforations on said inner injector.

11. A moisture delivery apparatus, comprising:

a liquid reservoir, wherein said liquid reservoir further comprises a liquid and an access to said liquid;

a plurality of wicks, wherein each of said plurality of wicks further comprises a first end, a second end opposite to said first end, and a body extending from said first end to said second end, wherein said body further comprises a first portion and a second portion, wherein said first portion of said body of said plurality of wicks is submerged in said liquid inside said liquid reservoir, wherein said second portion of said body of said plurality of wicks is above said liquid, wherein said first portion of said body of said plurality of wicks draws said liquid from said liquid reservoir to second portion of said body of said plurality of wicks, and wherein a vapor of said liquid is emitted from said second portion of said body of said plurality of wicks;

a supporting and adjusting structure for supporting and adjusting said body of said plurality of wicks, wherein said supporting and adjusting structure supports said plurality of wicks to extend above said liquid reservoir, wherein said supporting and adjusting structure adjusts a length of said first portion of said body of said plurality of wicks and a length of said second portion of said body of said plurality of wicks, wherein said first portion of said body of said plurality of wicks draws said liquid from said liquid reservoir to second portion of said body of said plurality of wicks, and wherein a vapor of said liquid is emitted from said second portion of said body of said plurality of wicks; and an enclosure, wherein said enclosure comprises a plurality of panels forming said enclosure, wherein said enclosure further comprises an access formed on one of said plurality of panels, wherein an object can ingress into or egress out of said enclosure through said access, wherein said enclosure can stand on said plurality of panels, wherein a relative humidity occurs inside said enclosure, wherein said supporting and adjusting structure further comprises a stanchion having a first end, a second end, an extended member between said first end and said second end, and a plurality of notches formed on said extended member, wherein said first end of said stanchion is disposed in said liquid reservoir, wherein said second end of said stanchion is extended above said liquid reservoir, and wherein said second portion of said body of said plurality of wicks is adjustable to be disposed on any one of said plurality of notches above said liquid of said liquid reservoir.

* * * * *